US005906313A

United States Patent [19]

Oliff

[11] Patent Number: 5,906,313

[45] Date of Patent: May 25, 1999

[54] CARTON AND A HANDLE THEREFOR

[75] Inventor: James R. Oliff, Douglasville, Ga.

[73] Assignee: The Mead Corporation, Dayton, Ohio

[21] Appl. No.: 08/871,933

[22] Filed: Jun. 10, 1997

[51] Int. Cl.[6] ..... B65D 5/468

[52] U.S. Cl. ..... 229/117.13; 229/920

[58] Field of Search ..... 206/140, 141, 206/427, 434; 229/117, 12, 117.13, 117.14, 920

[56] References Cited

U.S. PATENT DOCUMENTS

| | | | |
|---|---|---|---|
| 4,463,852 | 8/1984 | Stone | 229/110 |
| 4,637,515 | 1/1987 | Wilson et al. | 206/434 |
| 5,307,932 | 5/1994 | Stout et al. | 206/141 |
| 5,480,091 | 1/1996 | Stout | 229/117.14 |
| 5,482,203 | 1/1996 | Stout | 229/117.13 |
| 5,647,483 | 7/1997 | Harris | 206/427 |
| 5,772,030 | 6/1998 | Baxter | 206/427 |

FOREIGN PATENT DOCUMENTS

| | | | |
|---|---|---|---|
| 1 229 325 | 11/1987 | Canada . | |
| 2300711 | 9/1976 | France | 229/117.13 |
| 82 03615 | 9/1983 | France . | |
| 87 11249 | 2/1989 | France . | |
| 6600434 | 7/1966 | Netherlands | 229/117.13 |

*Primary Examiner*—Gary E. Elkins
*Attorney, Agent, or Firm*—Thomas A. Boshinski

[57] ABSTRACT

A carton formed from sheet material for containers such as cans or bottles includes a top wall, a pair of side walls and a bottom wall interconnected to form a tubular structure. A notional strip is defined along the top wall, having notional side edges, and extends between the end edges and has a width less than the distance between the side edges. A pair of hand apertures is defined in the top panel, disposed generally astride the notional strip and generally along the notional side edges. A cut line is formed in the top panel and extends from an end edge of the aperture along one of the notional side edges and curves away therefrom to a termination point, the cut line defining a radius of curvature and an area within the arc of curvature. At least one score line is defined in the top panel and extends from a first point disposed within the radius of curvature generally to an adjacent corner of the top panel.

6 Claims, 6 Drawing Sheets

CARTON AND A HANDLE THEREFOR

BACKGROUND OF THE INVENTION

The present invention relates generally to paperboard cartons for use in packaging articles. It is particularly useful for cartons for packaging containers such as cans or bottles for beverages, although the invention is not limited in this regard. More particularly, the invention relates to a handle for such cartons which is associated with stress-relieving severance lines.

Articles such as cans or bottles for beverages including soft drink, beer, juices and the like are commonly sold in multiple quantities packaged in a paperboard carton. For the convenience of the consumer, the carton is often provided with a handle, which commonly includes as a primary feature one or two slots or other apertures formed in the carton. These slots are commonly formed in a top wall of the carton. The user inserts the hand or fingers into one or both of the slots to lift the carton. Many varieties of handles of this type are known in the art.

Lifting a carton containing beverage cans or bottles introduces considerable stress into the paperboard from which the carton is formed. The region around the slot or slots especially tends to be subject to stress concentration. For this reason, and to prevent tearing of the paperboard and failure of the carton, it is known to design carton handles with various stress-relieving and/or stress-distributing arrangements. This is often accomplished by providing fold lines or slits in the carton wall where the handle slots are provided. An example of this type of stress distributing arrangement may be seen in U.S. Pat. No. 5,307,932.

While such arrangements have experienced considerable success, it has still been difficult to eliminate minor cracks and tears from the handle slot area. While these minor cracks or tears do not ordinarily result in handle failure, consumers may see these as undesirable and may not purchase packages exhibiting such cracks or tears.

What is needed, therefore, is a carton having a carrying handle with an improved stress-relieving arrangement. Such a carton should eliminate or reduce stress-induced tears or fractures, particularly those minor cracks and tears which detract from the carton appearance.

SUMMARY OF THE INVENTION

In accordance with one embodiment, the present invention provides a carton formed from sheet material for containers such as cans or bottles, including a top wall having opposed side edges and opposed end edges. A pair of side walls is provided, one of the side walls connected to each side edge of the top wall. A bottom wall is connected between the side walls to complete a tubular structure. A notional strip is defined along the top wall, having notional side edges, and extends between the end edges and has a width less than the distance between the side edges.

A pair of hand apertures is defined in the top panel and disposed generally astride the national strip and generally along the notional side edges. A cut line is formed in the top panel and extends from an end edge of the aperture along one of the notional side edges and curves away therefrom to a termination point, the cut line defining an area within the arc of curvature. At least one score line is defined in the top panel and extends from a first point disposed within the arc of curvature generally to an adjacent corner of the top panel.

A plurality of the cut lines may be formed in the top panel, one of the cut lines extending from each end edge of the aperture along one of the notional side edges and curving away therefrom to a termination point, the cut line defining a radius of curvature.

A plurality of groups of score lines may be provided in the top panel, with each of the groups extending from a first point disposed within one of the arcs of curvature generally to an adjacent corner of the top panel.

A reinforcing strip may be secured to an inner surface of the top panel, the reinforcing strip being disposed generally along the notional strip.

Each of the cut lines may terminate at the termination point in a generally J-shaped cut.

Each of the groups may include a plurality of score lines, each of which lines extend from within each of the arcs of curvature toward the respective one of the corners, the score lines within the group being arranged in a diverging arrangement toward the corner.

A termination cut line may be disposed substantially across each of the corners, the diverging score lines terminating at the termination cut line.

DETAILED DESCRIPTION OF THE PREFERRED EMBODIMENT

Figure 1:
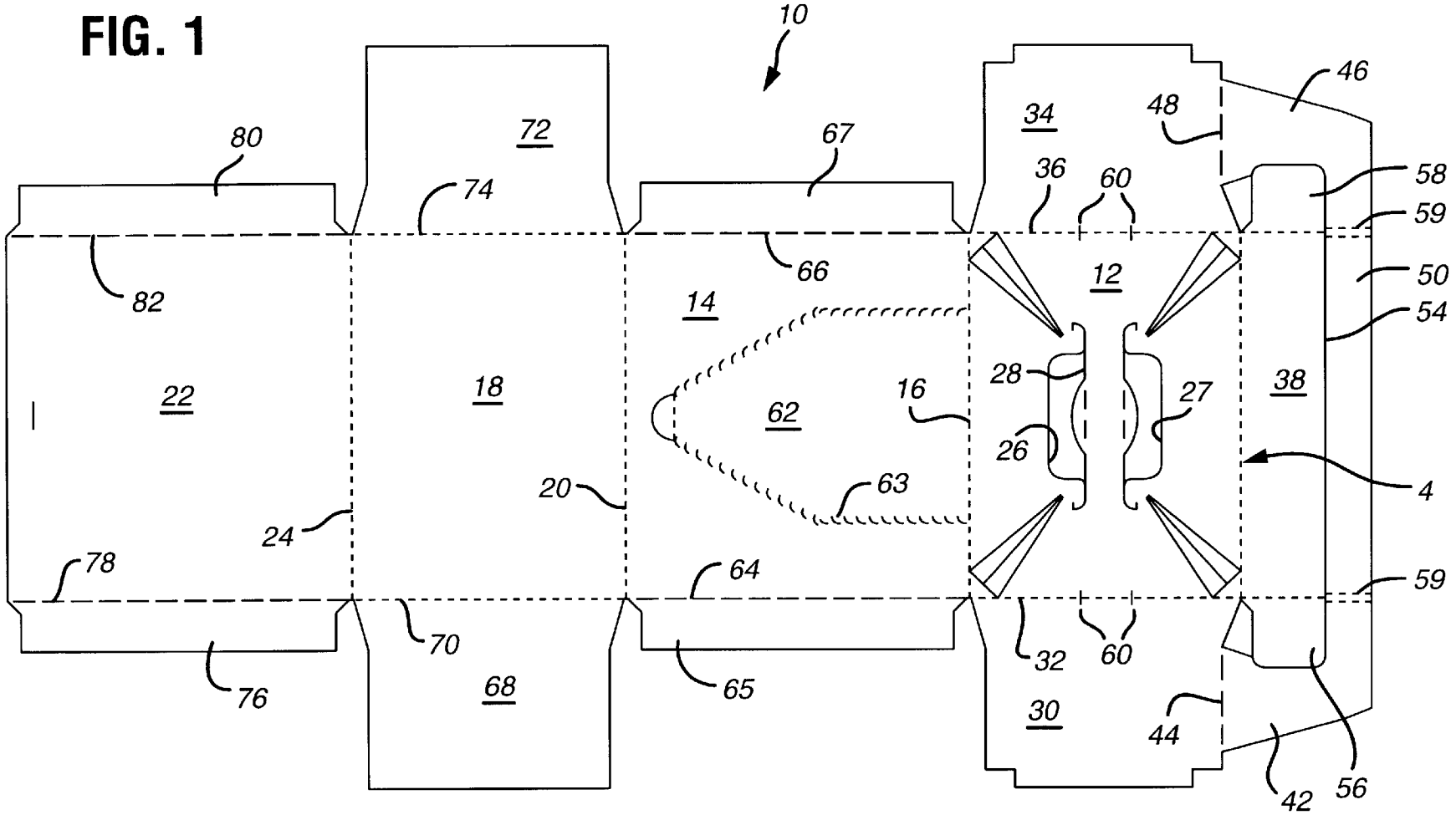
FIG. 1 is a plan view of the inner surface of a blank for forming a carton having a handle in accordance with the present invention.

A carton 10 for use in connection with the present invention may be seen in blank form by reference to FIG. 1, in which the inner surface of the blank is shown. The carton includes a top wall panel 12 connected to a side wall panel 14 along fold line 16. A bottom wall panel 18 is connected to side wall panel 14 along fold line 20, and at its opposite side is connected to side wall panel 22 along fold line 24.

A major end flap 30 is connected at one end edge of top wall panel 12 along fold line 32, while a second major end panel 34 is connected at the opposite end of top wall panel 12 along fold line 36. A glue flap 38 is connected to top wall panel 12 along fold line 40.

Side wall panel 14 includes a removable access panel 62 defined by a perforated tear line 63. Connected at one end edge of side wall panel 14 along fold line 64 is a minor end flap 65, and connected by a fold line 66 at an opposite end edge is minor end flap 67.

Bottom wall panel 18 has a major end flap 68 connected along fold line 70 at one end edge thereof, while a second major end flap 72 is connected at an opposite end edge along fold line 74.

Finally, side wall panel 22 includes a minor end flap 76 connected at one end edge along fold line 78, and a minor end flap 80 connected along fold line 82 at the opposite end edge.

Top wall panel 12 includes a pair of hand apertures 26 and 27 for forming a portion of a handle structure for the carton. These apertures are generally oval having generally straight edges including an inner edge 28. These apertures and other portions of the handle structure are discussed in greater detail below.

A handle reinforcing structure in accordance with the present invention is connected to each of major end flaps 30 and 34, and comprises end portion 42 connected to major end flap 30 along fold line 44, and end portion 46 connected to major end flap 34 along fold line 48. A central portion 50 interconnects end portions 42 and 46. Central portion 50 is positioned adjacent to glue flap 38, separated therefrom along a cut line 54.

Glue flap 38 includes end flap 56 which extends into end portion 42, and end flap 58 which extends into end portion 46.

End portions 42 and 46 are connected to the central portion 50 of the reinforcing strip along fold lines 59 which are debossed so as to protrude inwardly of the erected carton. These debossed areas mate with an area along respective ones of fold lines 32 and 36 which are encased by torque relief slits 60 to thereby reduce tension along the outer surfaces of the fold lines between top wall panel 12 and major end flaps 30 and 34. Further details regarding this structure may be found by reference to U.S. Pat. No. 5,320,277, which is incorporated herein by reference.

An additional reinforcing strip (not shown) may optionally be added to the handle reinforcing structure, disposed between central portion 50 and glue flap 38. Such a reinforcing structure may be seen in U.S. Pat. No. 5,482,203, which is incorporated herein by reference.

Figure 2:
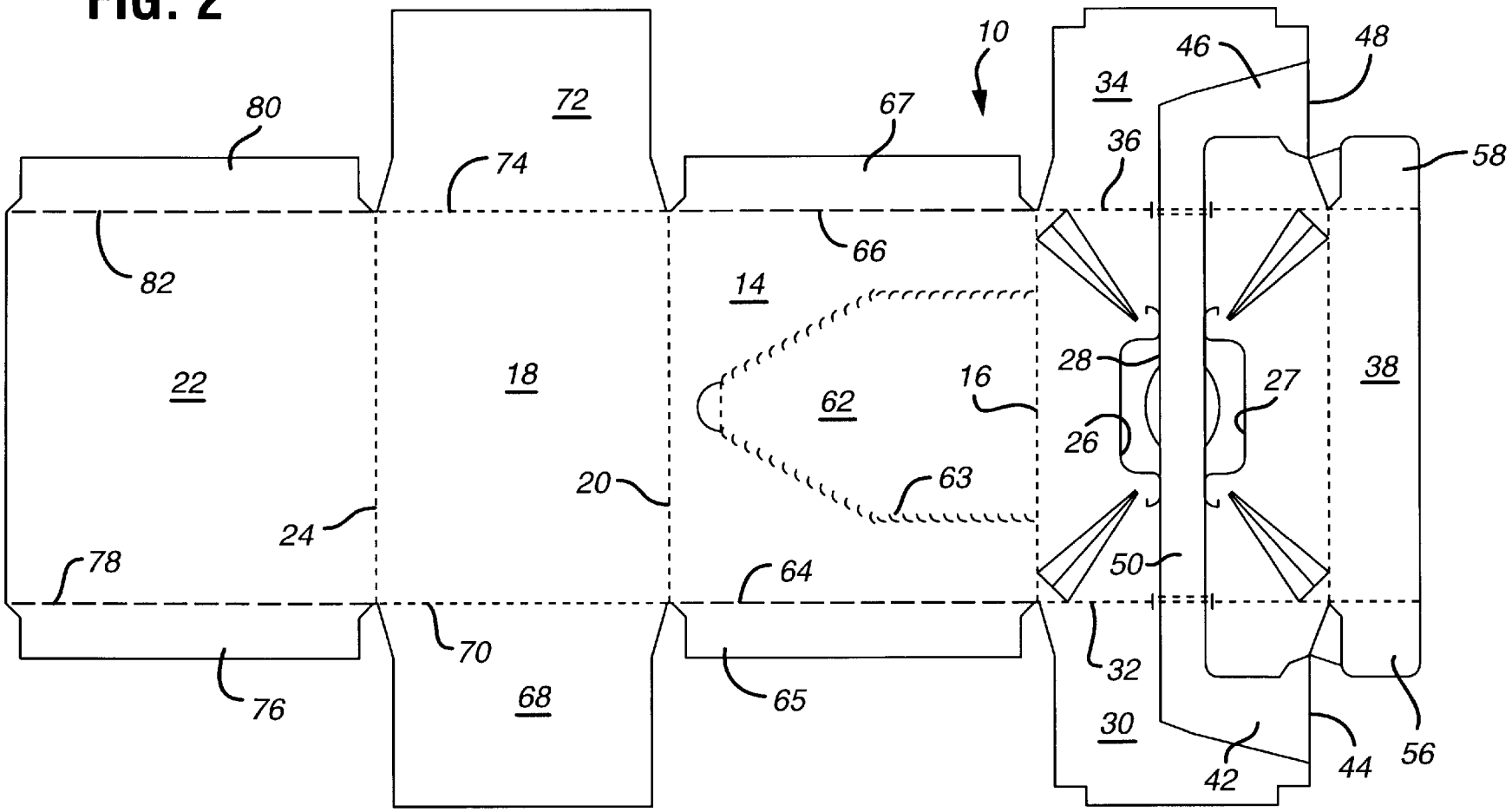
FIG. 2 is a partial plan view similar to FIG. 1, showing a first step in the formation of a carton from the blank of FIG. 1.

Referring now to FIG. 2, a portion of the blank for carton 10 can be seen, showing the beginning of the assembly process for the carton. The handle reinforcing structure is folded about fold lines 44 and 48, and end portions 42 and 46 are glued to major end panels 30 and 34, respectively. Central portion 50 is glued to top wall panel 12, so as to extend along the region between the hand apertures 26 and 27. Thus, a double-ply reinforced structure between the apertures 26 and 27 is formed.

When central portion 50 is positioned on the underside of central panel 12 as shown in FIG. 2, a notional strip can be defined along central panel 12, extending between its end edges. This notional strip passes between the hand apertures 26 and 27, with its edges aligned with the generally straight inner edges 28 of apertures 26 and 27.

Figure 3:
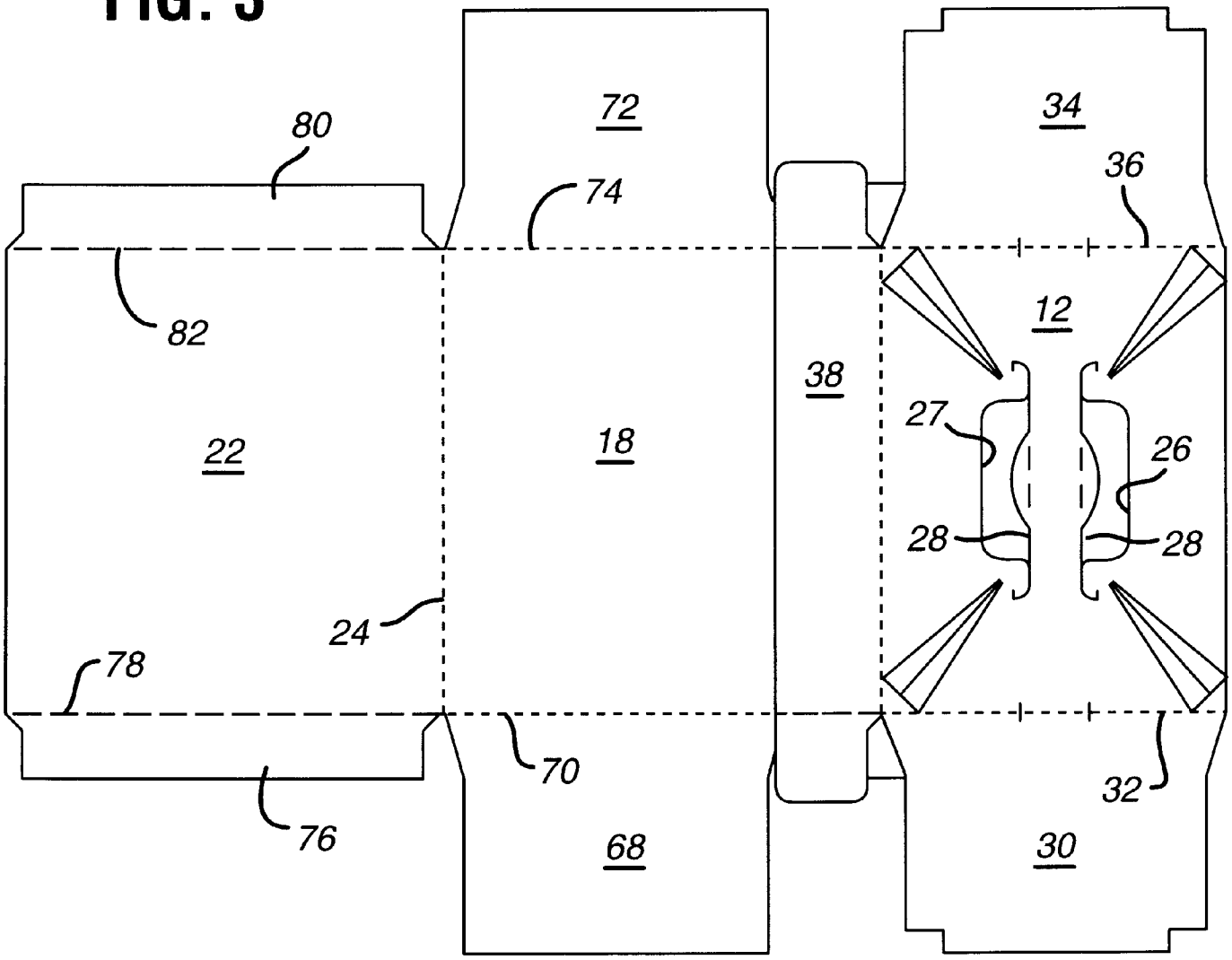
FIGS. 3 and 4 are plan views of the blank of FIGS. 1 and 2, further illustrating the formation of the carton.
Figure 4:
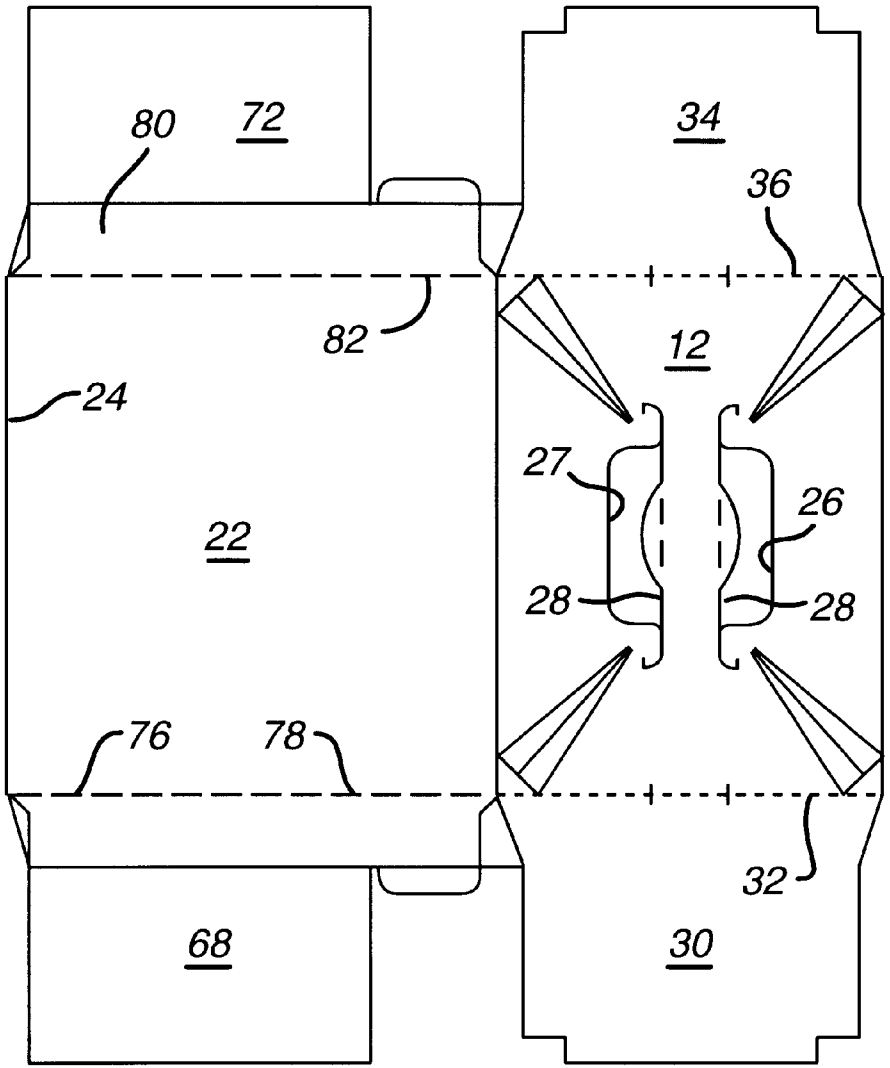

The remainder of the assembly of carton 10 can be seen by reference to FIGS. 3 and 4. In FIG. 3, the top wall panel 12 is shown folded along fold line 16 into overlapping arrangement with side wall panel 14. Glue is applied along glue flap 38 and, as shown in FIG. 4, side wall panel 22 is folded along fold line 24. The upper edge of side wall panel 22 is then adhered to glue flap 38 to complete the collapsed carton.

Figure 5:
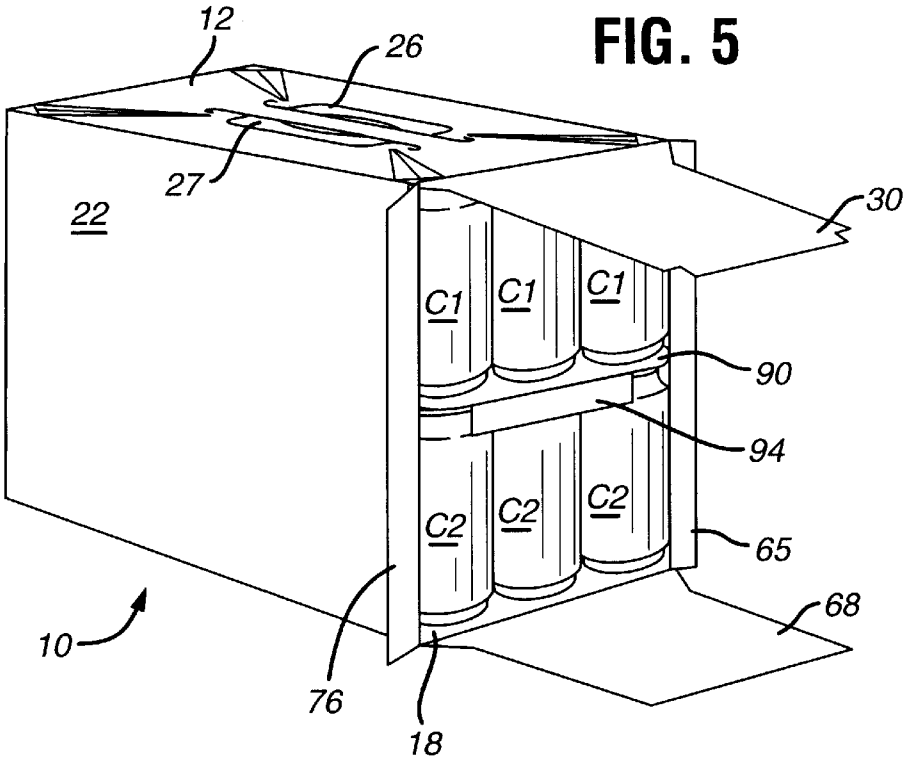
FIG. 5 is a three-quarter view of the top, side and end of an erected and loaded carton formed from the blank of FIG. 1, showing the end closure structure prior to folding and sealing.

The carton is loaded as shown in FIG. 5. First, the carton is erected into a tubular structure. The carton 10 is shown with its end closure structure, comprising major end flaps 30 and 68 and minor end flaps 65 and 76, open prior to the application of glue for sealing. The carton is loaded, as shown here for example, with beverage cans arranged into two tiers. A divider insert 90 is positioned between the tiers. Cans C1 of the upper tier are positioned on insert 90, which in turn rests upon the tops of the cans C2 of the lower tier. Cans C2 are in turn positioned on the bottom wall panel 18 of the carton 10. The can arrangement, as is conventional, is assembled prior to loading, and the stacked and arranged cans are loaded by pushing into the carton tube through one or both of its open ends. Such operation may be carried out by suitable, commercially-available automated packaging machinery.

Closure and sealing of the end closure structure is effected in the following manner. Minor end flaps 65 and 76 are folded to a closed position against the packaged cans. Glue is applied to minor end flaps 65 and 76 and, preferably, to end flap 94 attached along a fold line to the edge of insert 90. Major end flap 30 is then folded downwardly and secured to the flaps 65, 76 and 94. Additional glue is applied to the outer end of the inner surface of major end flap 68, which is folded upwardly and sealed to major end flap 30.

An identical operation is carried out to close and seal end closure structure located at the opposite end of the carton. (In a preferred embodiment of the invention, the carton is loaded from one end only using automated packaging machinery. During such a loading operation, The opposite, non-loaded carton end is closed and sealed before the cans are pushed into the carton.)

Figure 6:
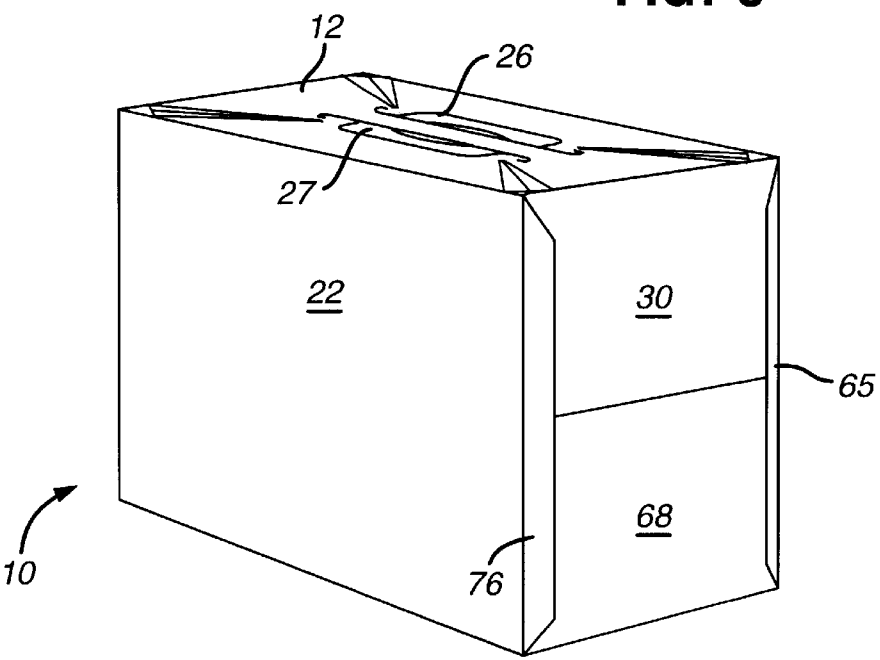
FIG. 6 is a view similar to FIG. 5, but showing the end closure structure sealed to form the finished carton.

The loaded and sealed carton may be seen by reference to FIG. 6.

Figure 7:
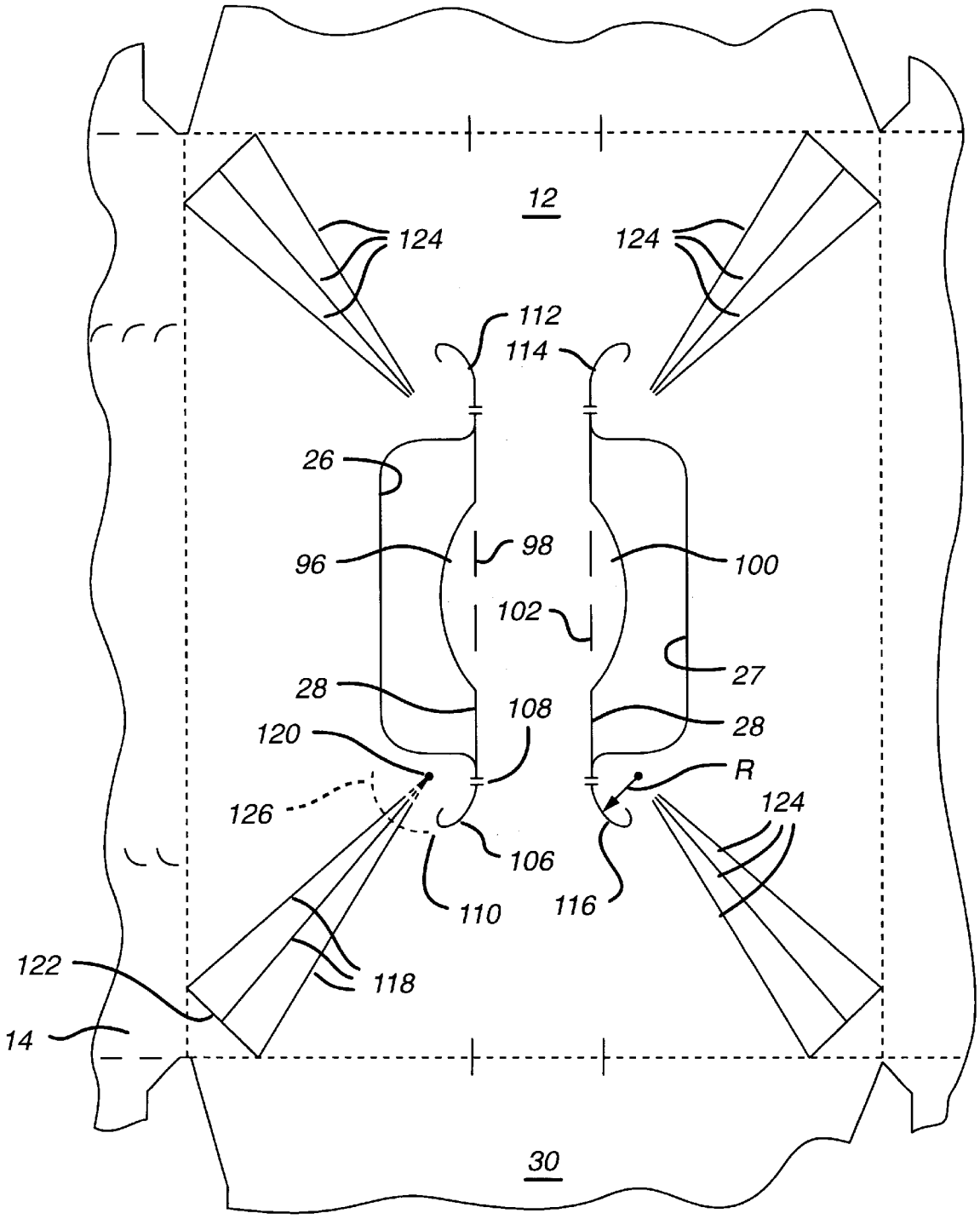
FIG. 7 is an enlarged view of the top panel portion of the blank shown in FIG. 1.

The handle arrangement formed on panel 12 may be seen in greater detail by reference to FIG. 7. A cushion flap 96 is disposed along the generally straight inner edge 28 of aperture 26, connected to panel 12 by fold line 98. A similar cushion flap 100 is connected to panel 12 by fold line 102. It will be recognized that in the completed carton, the fold lines 98 and 102 will lie substantially along the side edges of the underlying central portion 50 of the reinforcing strip.

A cut line 106 extends from an end of aperture 26 along the line defined by the inner edge 28 of the aperture. A nick 108 may join the portions of paperboard on each side of the cut line 106 until such time as the nick is broken by use of the handle.

Continuing to refer to FIG. 7, the cut line 106 curves away from the notional strip defined between the apertures 26 and 27, and terminates is a J-shaped cut 110.

A similar cut line 112 extends from the opposite end of aperture 26, and similar cut lines 114 and 116 extend from the ends of aperture 27.

A plurality of stress-diverting score lines 118 are formed into panel 12 to extend from adjacent aperture 26 to the respective corner of top wall panel 12 at side wall panel 14 and end panel 30, in a manner similar to that taught in U.S. Pat. No. 5,307,932, which is incorporated herein by reference. In a preferred embodiment of the present invention, three such score lines 118 are provided, and extend in diverging fashion from a point 120 located closely adjacent the edge of aperture 26. (For manufacturing reasons, the portion of score lines 118 immediately at and adjacent to point 120 are not formed. This has no effect on handle performance, so long as the termination point of the formed score lines is positioned as will be described herein.) A cut line 122 extends diagonally across the corner of top wall panel 12, at which the group of score lines 118 terminates.

Similar groups of score lines 124 extend from adjacent the ends of tear lines 112, 114 and 116 toward the respective corners of top panel 12.

In the specific embodiment disclosed, three diverging score lines are shown in each group. However, other arrangements of score lines may be used with the handle disclosed herein. For example, conventional, single score lines extending toward each corner may be used.

Alternatively, the multiple-score line arrangements shown in U.S. Pat. Nos. 5,379,944 or 5,385,234 may be used. Still other arrangements could be used. In any case, the score lines extend from adjacent the hand apertures to the respective corners of the top wall panel.

It will be seen from FIG. 7 that the handel aperture 26 (as well as aperture 27) is formed with a width of "W". For cartons for use in packaging beverage cans, it is expected that the width W will be less than or equal to the can radius, although this dimension is determined more by the needed width for insertion of the user's hand, balanced by the need to avoid an overly large opening which may adversely affect package security.

As shown in FIG. 7, and with specific reference to cuts 106 and 116, in the preferred embodiment, the cut lines 106, 112, 114 and 116 curve away from the notional strip along a radius of curvature "R" which is substantially one-half W. The cut preferably extends through a degree of curvature of approximately 90°.

Score lines 118 can be seen to terminate inside the radius of curvature of cut line 106. While it is not necessary for the score lines 118 to extend completely to the edge of aperture 26 (and may not be desirable for manufacturing reasons), it is important that the score lines effectively pass by the J-shaped cut 110 and into the area within the arc defined by the curvature of cut 106. (Note phantom line 126.)

In use, when lifting the loaded carton, a user inserts the hand and/or fingers into the apertures 26 and 27 and grasps the portion of panel 12 therebetween. The user then lifts the carton. The weight of the carton causes cut lines 106, 112, 114 and 116 to open. This directs the tear stress introduced by lifting the carton along the cut lines, away from the high-stress region of the carton, and to the J-shaped cuts 110 which resist further tearing. Because of the stress-relieving score lines 118 and 124 which extend from within the curvature of cut lines 106, 112, 114 and 116, most of the stress is directed along these score lines toward the carton corners.

It should be readily recognized that while in the preferred embodiment, the present invention has been described in connection with a carton for packaging two tiers of cans, the handle structure may also be used with a carton for packaging only a single tier of cans, or for a carton for packaging bottles, jars or other containers or articles. The containers may be oriented vertically, as described herein, or horizontally.

Further, it should be recognized that various handle reinforcing means other than the folded panel 50 described herein may be used with the disclosed handle. For example, rather than a single top panel 12 and the reinforcing structure comprising portions 42, 44 and 50, a lapped top panel of a type generally known in the art may be used. In such an embodiment, the overlap between the two top panel portions forms a double-ply strip which extends down the center of the carton top wall. An example of a carton of this type may be seen in U.S. Pat. No. 5,427,242, which is incorporated herein by reference. The handle structure is formed into the lapped top panel in the same manner as the handle structure described herein, as will be readily appreciated by those skilled in the art. In such an embodiment, the tear lines 106, 112, 114 and 116 are formed to begin along the edges of the lapped portion, and curve away therefrom.

It will be further recognized that it is not necessary that the handle apertures be formed with exactly the shape disclosed herein. As one example, the apertures may be formed as ovals having completely rounded ends as shown in the above-referenced U.S. Pat. No. 5,427,242. In such a case, the cut lines and score lines are provided in the same manner as described herein. Other shapes for the handle apertures will be readily apparent to those skilled in the art.

Moreover, the handle arrangement of the present invention may be used with cartons having a different shape than that described herein. As one example, a carton having "beveled" corners may be used, similar to that shown in U.S. Pat. No. 5,480,091, which is incorporated herein by reference. In such a case, the handle is formed into the carton in the same manner as described herein, except that the edge of the beveled corner formed at each corner of the top wall panel functions as the cut 122 described in connection with the preferred embodiment.

It will also be recognized that as used herein, directional references such as "top", "bottom", "end" and "side" do not limit the respective panels to such orientation, but merely serve to distinguish these panels one from another.

What is claimed is:

1. A carton formed from sheet material for containers such as cans or bottles, comprising:

a top wall having opposed side edges and opposed end edges;

a pair of side walls, one of the side walls connected to each said side edge of said top wall;

a bottom wall connected between said side walls to complete a tubular structure;

a notional strip defined along said top wall, having notional side edges, and extending between said end edges and having a width less than the distance between said side edges;

a pair of hand apertures, each defined in said top panel and disposed generally astride said notional strip and generally along said notional side edges;

a cut line formed in said top panel and extending from an end edge of one of said hand apertures along one of said notional side edges and curving away therefrom to a termination point, said cut line defining a radius of curvature and an area within the arc of said curvature;

at least one score line defined in said top panel and extending from a first point disposed within said area within the arc of said curvature generally to an adjacent corner of said top panel.

2. A carton formed from sheet material for containers such as cans or bottles, comprising:

a top wall having opposed side edges and opposed end edges;

pair of side walls, one of the side walls connected to each said side edge of said top wall;

a bottom wall connected between said side walls to complete a tubular structure;

a notional strip defined along said top wall, having notional side edges, and extending between said end edges and having a width less than the distance between said side edges;

a pair of hand apertures, each defined in said top panel and disposed generally astride said notional strip and generally along said notional side edges, each of said apertures defining an end edge oriented generally toward said end edges of said top panel;

a plurality of cut lines formed in said top panel, one of said cut lines extending from each end edge of each of said apertures along one of said notional side edges and curving away therefrom to a termination point, said cut line defining a radius of curvature and an area within the arc of said curvature;

a plurality of score line arrangements each comprising at least one score line defined in said top panel, each of said score line arrangements extending from a first point disposed within one of said areas within the arc of said curvature generally to an adjacent corner of said top panel.

3. A carton as defined in claim 2, further comprising a reinforcing strip secured to an inner surface of said top panel, said reinforcing strip being disposed generally along said notional strip.

4. A carton as defined in claim 2, wherein each of said cut lines terminates at said termination point in a generally J-shaped cut.

5. A carton as defined in claim 2, wherein each of said score line arrangements includes a plurality of score lines which extend from within each of said areas within the arc of said curvature toward the respective one of said corners, said score lines within said group being arranged in a diverging arrangement toward said corner.

6. A carton as defined in claim 5, further comprising a termination cut line disposed substantially across each of said corners, said diverging score lines terminating at said termination cut line.

* * * * *